United States Patent [19]

Ruopsa

[11] Patent Number: 4,811,527

[45] **Date of Patent: * Mar. 14, 1989**

[54] PARTICLE COLLECTION SYSTEM WITH SPOILER

[76] Inventor: Jon A. Ruopsa, 11834 S. Ki Rd., Phoenix, Ariz. 85044

[ * ] Notice: The portion of the term of this patent subsequent to Oct. 6, 2004 has been disclaimed.

[21] Appl. No.: 132,792

[22] Filed: Dec. 14, 1987

[51] Int. Cl.[4] ..... B24B 55/06
[52] U.S. Cl. ..... 51/270; 51/273
[58] Field of Search ..... 51/270, 273, 268

[56] References Cited

U.S. PATENT DOCUMENTS 4,697,390 10/1987 Ruopsa ..... 51/270

FOREIGN PATENT DOCUMENTS 1024838 2/1958 Fed. Rep. of Germany ..... 51/270
45865 3/1983 Japan ..... 51/273
759301 8/1980 U.S.S.R. .

*Primary Examiner*—Roscoe V. Parker
*Attorney, Agent, or Firm*—Tod R. Nissle

[57] ABSTRACT

Improved abrading apparatus. The apparatus includes a rotating abrasive stone and, to minimize the quantity of abraded particles which escape from the apparatus into the surrounding environment, utilizes a closed circuit air flow and utilizes a protective air curtain between the rotating abrasive stone and a user.

1 Claim, 2 Drawing Sheets

PARTICLE COLLECTION SYSTEM WITH SPOILER

This invention relates to apparatus for abrading jewelry and other objects.

More particularly, the invention relates to abrading apparatus which includes a rotating abrasive stone and which, to minimize the number of abraded particles which escape from the apparatus into the surrounding environment, utilizes a closed circuit air flow and utilizes a protective air curtain between the rotating abrasive stone and a user.

In a further aspect, the invention relates to polishing apparatus of the type described which directs air through a venturi and a plurality of flow channels to produce a protective laminar air curtain intermediate the user and abrading wheel.

Various kinds of well known abrading apparatus are utilized in jewelry and craft stores. In such apparatus a piece of jewelry or other object is pressed against a rotating abrasive wheel to abrade the object. Abraded particles of metal downwardly torn from the jewelry by the abrasive wheel are captured in a porous filter or in a basis formed beneath the abrading wheel. A fan or suction unit is utilized to form a stream of air traveling from the grinding wheel into the filter. Such prior art polishing apparatus systems have several disadvantages. First, such apparatus normally contain a vent through which air is, after being drawn through a filter in the apparatus, exhausted into the surrounding atmosphere. Invariably, some fine particulate passes through the filter and into the exhaust system. This fine particulate adheres to the walls, floor and equipment around the abrading apparatus. In many jewelry stores, the walls near polishing apparatus are black or otherwise discolored from particulate carried in the exhaust of the polishing apparatus. Another problem with prior art apparatus is that during the abrading of the jewelry, some of abraded particles are not drawn into the filter but instead escape out of the front of the machine toward and onto the user.

Accordingly, it would be highly desirable to provide improved abrading apparatus which would eliminate or markedly reduce the amount of particulate escaping from the apparatus onto the user and into the area surrounding the abrading apparatus.

Therefore, it is a principal object of the invention to provide improved abrading apparatus.

Another object of the instant invention is to provide improved abrading apparatus of the type including a rotating abrasive wheel and a basin to capture particles torn from an object being abraded with the abrasive wheel.

A further object of the invention is to provide improved abrading apparatus of the type described including a closed circuit air flow which draws abraded particles produced by the abrading wheel into a particle collection chamber and filter.

Still another object of the invention is provide improved abrading apparatus of the type described which prevents particles thrown from the abrading wheel toward the user from escaping from the closed air circuit circulating through the apparatus.

Yet still another object of the invention is to provide improved abrading apparatus of the type described which forms a laminar flow air curtain to capture abraded particles produced by the apparatus.

These and other, further and more specific objects and advantages of the invention will be apparent to those skilled in the art from the following detailed description thereof, taken in conjunction with the drawings, in which.

Briefly, in accordance with my invention, I provide improved abrading apparatus. The apparatus includes a housing having a front wall and a rear wall and a particle receiving basis between the front and rear walls; a circular abrading wheel mounted on an axle in the housing above the particle receiving basin and having a cylindrical outer peripheral portion; a motor mounted in the housing and operatively associated with the axle to rotate the axle and abrading wheel, a workpiece normally being held against and contacting the abrading wheel in a position such that particles abraded from the workpiece by the wheel are downwardly thrown toward the basin; a first air channel formed in the housing for downwardly directing a vertically oriented curtain of air over the portion of the grinding wheel contacting the workpiece and carrying abraded particles into the basin; particle depository means in the housing having a floor and an upright wall attached to and extending upwardly from the floor; a second air channel in the housing between the basin and particle depository means; recirculating fan means in the housing having an intake and an exhaust port; a third air channel in the housing between the particle depository means and the intake port of the fan means; and, a fourth air channel in the housing between the exhaust port of the fan means and the first air channel, the cross sectional area of the fourth air channel tapering from the exhaust port to the first channel means to accelerate the flow of air through the fourth air channel. The particle depository means and the first, second, third, and fourth air channels and the depository basin are shaped and dimensioned such that air continuously flows in a closed circuit through the first channel, the basis, the second channel, the depository means, the third channel, the fan means, and the fourth channel, respectively. Air flows through the second channel into the depository means in a first direction of travel and flows from the depository means into the third channel in a second direction of travel. When the air flow changes from the first to the second direction of travel, at least certain of the abraded particles in the air generally continue in the first direction of travel and strike the upright wall of the particle depository means and fall toward the floor under the force of gravity.

Figure 1:
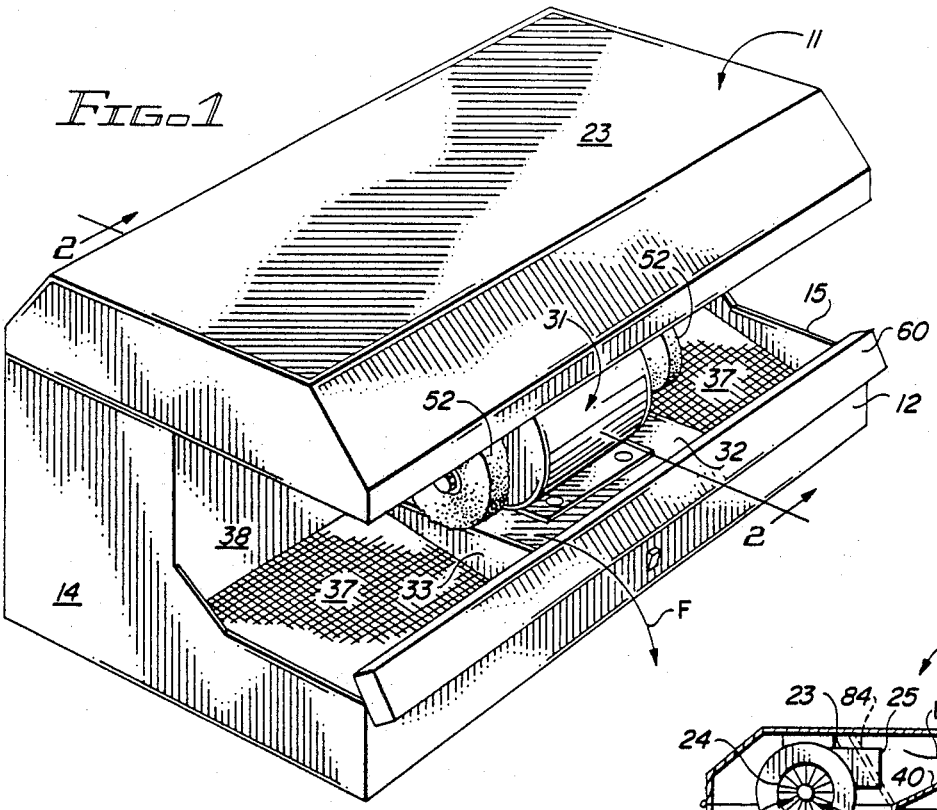
FIG. 1 is a perspective view illustrating abrading apparatus constructed in accordance with the principles of the invention.
Figure 2:
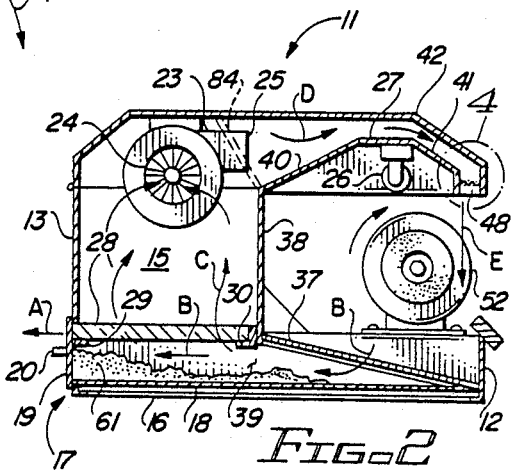
FIG. 2 is a section view of the apparatus of FIG. 1 taken along section line 2—2 thereof and further illustrating internal construction details thereof.
Figure 3:
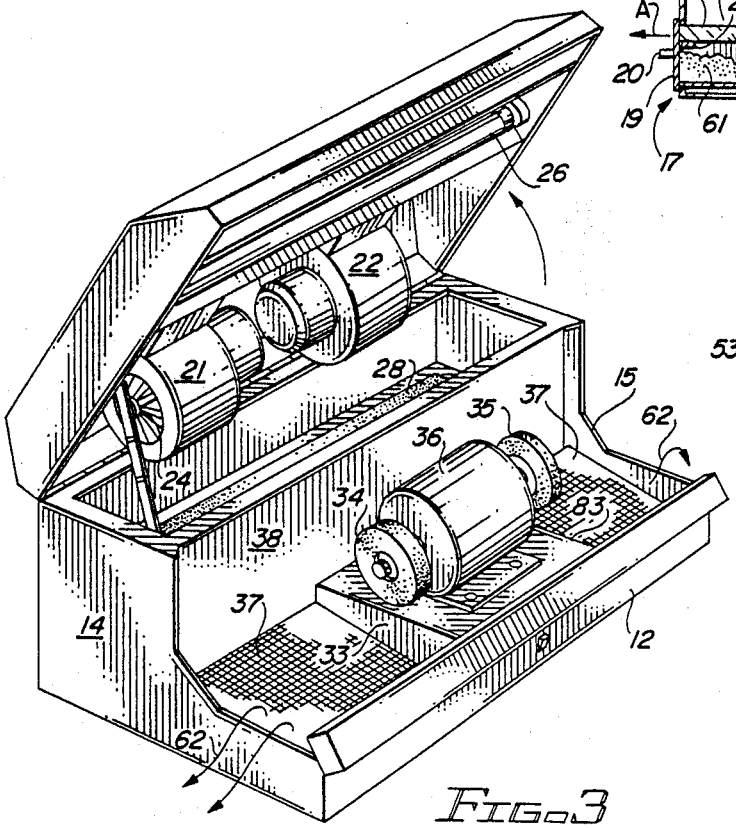
FIG. 3 is a perspective view of the polishing and grinding apparatus of FIG. 1 illustrating the mode of operation of the lid thereof; and, FIG. 4 is a perspective view of a portion of the lid of FIG. 2 illustrating the channels formed therein to cause the laminar flow of air therethrough.
Figure 4:
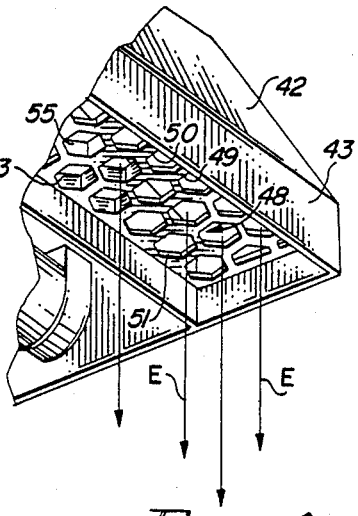

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1–4 illustrate the presently preferred embodiment and best mode of the invention, including a housing having a pivotally mounted lid 11, front wall 12, rear wall 13, side walls 14 and 15, and bottom 16. Drawer or particle depository 17 is slidably inserted in the housing above bottom 16 and includes floor 18 and upright wall 19 attached to and extending upwardly from floor 18. Handle 20 attached to wall 19 enables drawer 17 to be slidably pulled out in the direction of arrow A. Fan units 21, 22 are attached to the roof 23 of lid 11 and each include an intake port 24 and exhaust port 25. Light bulb 26 is mounted on elongate panel 27 of lid 11. Filter 28 is supported by lips 29, 30 of drawer 17 and can be lifted upwardly therefrom. Grinding and polishing apparatus 31 is mounted on platform 32. Platform 32 includes side walls 33, 83. Side wall 33, front wall 12 and the forward portions of end wall 14 and bottom 16 define a first basin into which abraded particles produced by rotating cylindrical grinding stone 34 are downwardly directed. Motor 36 rotates the axles on which stones 34, 35 are fixedly attached. Removable screen 37 functions as a baffle which prevents air and abraded particles directed into the basis from rebounding upwardly out of the basin and onto the area surrounding the apparatus. Front wall 12, side wall 83, and the forward portions of bottom 16 and end wall 15 define a second basin into which abraded particles produced by rotating cylindrical grinding stone 35 are downwardly directed. Floor 18 and the lower edge of wall 38 bound channel 39 leading from the first basin to drawer 17. Particle laden air flows from the first basin into drawer 17 in the direction of travel indicated by arrow B. Walls 38 and 13 bound the channel leading upwardly from drawer 17 to fan units 21 and 22. Air flowing upwardly from drawer 17 to fan units 21 and 22 travels in the direction indicated by arrow C. When air traveling in the direction of arrow B changes direction to move in the direction of travel indicated by arrow C, some of the heavier particles in the air continue to travel in the direction of arrow B and to fall to floor 18 or to impact wall 19 and fall to floor 18. Air traveling upwardly in the direction of arrow C passes through filter 28 which removes additional particles from the air stream. Air flowing upwardly into fan units 21 and 22 is drawn into intakes 24 and exhausted through ports 25 in the direction of arrow D. Roof 23, elongate panel 40 and panel 27 bound the third channel carrying air in the direction of arrow D to the first channel. The first channel is bounded and defined by panels 41 and 42. As illustrated in FIG. 2, the third channel tapers, increasing the speed of air flowing into the first channel. Air exiting the first channel flows through honeycomb screen 48. When the air stream flows through the third channel into the first channel, turbulence occurs in the air stream. Screen 48 minimizes this turbulence and produces a laminar flow air curtain traveling downwardly in the direction of arrows E over wheels 34 and 35 at the points 52 at which a workpiece is held against the wheels 34 and 35. The thickness of screen 48 can be minimal such that the distance of travel through apertures formed therein is minimal, as is the case with apertures 49–51 in FIG. 4. It is preferred that screen 48 be at least 0.25 inch thick so that laminar flow of air through apertures in the screen is well established prior to the air exiting the screen in the direction of arrows E. In FIG. 4, apertures 55 and 53 are formed in portions of screen 48 having greater thickness. Screen 48 is preferably one to two inches thick.

In operation, lid 11 is closed to the position shown in FIG. 1, fan units 21 and 22 are turned on, and motor 36 is operated to rotate abrasive wheels 34 and 35. A workpiece is placed against the wheel 34 (or 35) preferably at point 52. The air curtain traveling in the direction of arrows E insures that most, if not all, abraded particles produced by wheel 34 are carried into the first basin and do not escape over ledge 60 in the direction indicated by arrow F in FIG. 1. The air stream travels into and through the first basin in the direction of arrow B and is drawn upwardly toward fan units 21 and 22 in the direction of arrow C. The heavier particles in the air stream travel under the force of gravity onto floor 18 or against wall 19 and collect in drawer 17 when the air streams turns upwardly in the direction of arrow C. Turbulent air flow which develops near wall 19 also helps trap particles 61 in drawer 17. The air steam traveling in the direction of arrows C is drawn into intake port 24 and flows out of fan unit 21 in the direction of arrow D. While traveling in the direction of arrow D, the speed of flow of the air stream is increased by the tapering third venturi channel. When the air stream flows through the first channel, apertures 49–51, 53, 55 produce laminar air flow in the direction of arrows E. The closed circuit continuous air flow in the apparatus of FIGS. 1–4 minimizes the volume of particulate which escapes from the apparatus into the surrounding environment. The laminar air curtain, screen baffles 37 and first and second basins are also important features in maximizing the number of particles of abraded material captured in the apparatus. The first and second basins and screen baffles 37 minimize the amount of particulate laden air which can flow over side walls 14, 15 and escape the basins in the manner indicated by arrows 62 in FIG. 3.

As indicated by dashed lines 84 in FIG. 2, an additional panel member can be installed in lid 11 to prevent air traveling upwardly in the direction of arrow C from bypassing intake port 24 and flowing directly into the third venturi channel in the direction of arrow D. When panel member 11 is installed, air flowing in the direction of arrow C is forced to flow into intake port 24.

Figure 5:
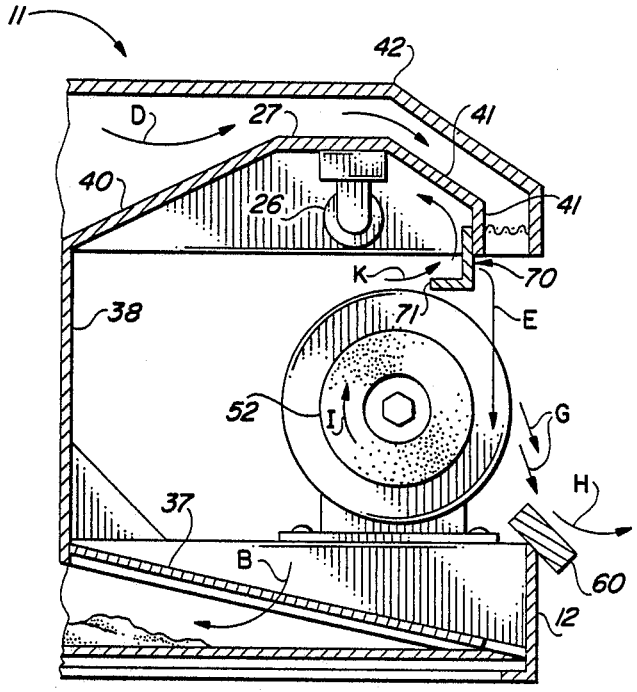
Figure 6:
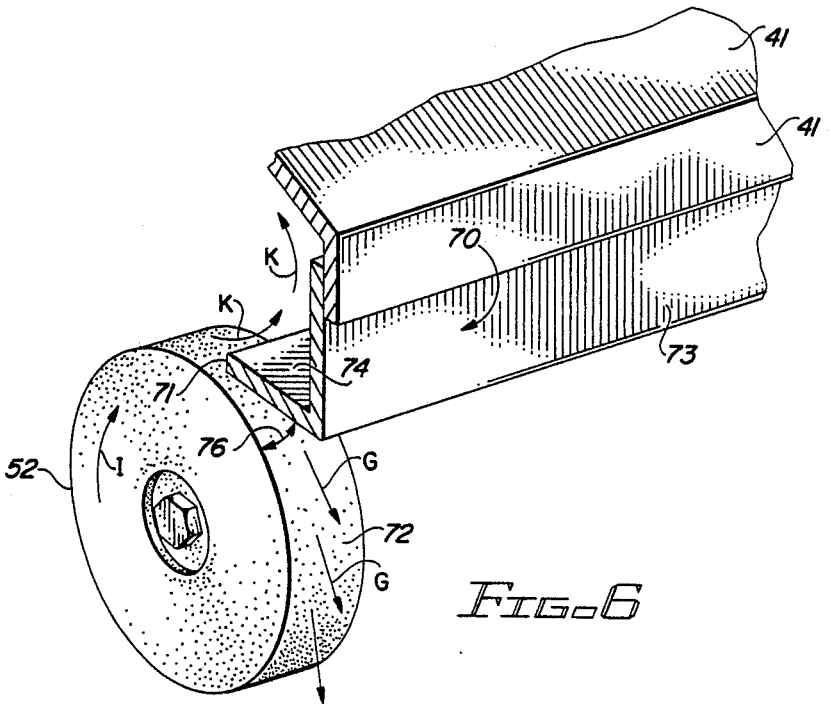

In the embodiment of the invention shown in FIGS. 5 and 6, an air baffle 70 minimizes the amount of excess air flow and particle flow over ledge 60. During the rotation of grinding wheel 52 in the direction of arrow I, air adjacent the wheel is caused to move in a circular peripheral flow in the direction of arrows G. An outward angular velocity component is imparted to air moving in the direction of arrows G. This outward angular velocity tends to cause air to move outwardly from wheel 52 over ledge 60 in the manner indicated by the arrow H in FIG. 5. Further, any minute particulate carried by the air flowing around wheel 52 also tends to take on an outward angular velocity component and move outwardly over ledge 60 in the manner indicated by arrow H. When L-shaped baffle 70 is attached to panel 41 in the manner indicated in FIGS. 5 and 6, air and particulate traveling around the periphery of wheel 52 is deflected upwardly away from the wheel 52 in the manner indicated by arrows K in FIGS. 5 and 6. The deflection of air flow and particulate in the direction of arrows K further minimizes the amount of particulate which escapes outwardly from the unit in the direction of arrow H.

In order to maximize the amount of air deflected in the direction of arrows K, the lower ledge 71 of L-shaped baffle 70 is placed adjacent to the outer cylindrical peripheral surface 72 of wheel 52 as closely as possible without allowing edge 71 to contact surface 72.

L-shaped baffle 70 includes panel shaped legs 73 and 74. The angle 76 of leg 74 with respect to surface 72 can vary as desired; however, regardless of the size of angle 76, leg 74 outwardly extends from surface 72 and functions to deflect outwardly from wheel 52 air which normally moves in the generally circular direction of flow indicated by arrows G. Furthermore, the deflected air is, in the manner illustrated in FIGS. 5 and 6, preferably directed upwardly beneath panels 41 and 27 and directed away from curtain E, from the first channel, and from the opening intermediate ledge 60 and panel 43. Baffle 70 can consist of a member having any desired shape and dimension as long as baffle 70 functions to direct peripheral circular airflow away from wheel 52 in the manner indicated by arrows K in FIGS. 5 and 6.

Having described my invention in such terms as to enable those skilled in the art to understand and practice it, and having identified the presently preferred embodiments thereof, I Claim:

1. Abrading apparatus including (a) a housing having a front wall and a rear wall and a particle receiving basin between said front and rear walls;

(b) a circular abrading wheel mounted on a axle in said housing above said particle receiving basin and having a cylindrical outer peripheral portion;

(c) a motor mounted in said housing and operatively associated with said axle to rotate said axle and abrading wheel, a workpiece normally being held against and contacting said wheel in a position such that particles abraded from said workpiece by said wheel are downwardly thrown toward said basin, air flowing around and adjacent said outer portion of said wheel in a circular path of travel when said abrading wheel is rotated by said motor;

(d) a first air channel formed in said housing for downwardly directing a vertically oriented curtain of air over said portion of said grinding wheel contacting said workpiece and carrying abraded particles into said basin;

(e) particle depository means in said housing having a floor and an upright wall attached to and extending upwardly from said floor;

(f) a second air channel in said housing between said basin and particle depository means;

(g) recirculating fan means in said housing having an intake and an exhaust port;

(h) a third air channel in said housing between said particle depository means and said intake ports of fan means;

(i) a fourth air channel in said housing between said exhaust port of said fan means and said first air channel, the cross sectional area of said fourth air channel tapering from said exhaust port to said first channel means to accelerate the flow of air through said fourth air channel;

(j) a baffle member attached to said housing and adjacent said abrading wheel to deflect outwardly away from said wheel said air flowing around said rotating abrading wheel; said particle depository means and said first, second, third and fourth air channels and basin being shaped and dimensioned such that (k) air continuously flows in a closed circuit through said first channel, said depository means and said fourth channel; and, (l) air flows through said second channel into said depository means in a first direction of travel and flows from said depository means into said third channel in a second direction of travel and, when said air flow changes from said first to said second direction of travel, at least certain of said abraded particles in said air generally continue in said first direction of travel and strike said upright wall of said particle depository means and fall toward said floor under the force of gravity.

* * * * *